US007032579B2

(12) United States Patent
Nishida et al.

(10) Patent No.: US 7,032,579 B2
(45) Date of Patent: Apr. 25, 2006

(54) EXHAUST GAS RECIRCULATION DEVICE OF ENGINE

(75) Inventors: Ryotaro Nishida, Hiroshima (JP); Fusatoshi Tanaka, Hiroshima (JP); Einosuke Suekuni, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 10/895,134

(22) Filed: Jul. 21, 2004

(65) Prior Publication Data

US 2005/0039730 A1 Feb. 24, 2005

(30) Foreign Application Priority Data

Aug. 21, 2003 (JP) ..... 2003-297393
Aug. 21, 2003 (JP) ..... 2003-297401

(51) Int. Cl.
*F02M 25/07* (2006.01)

(52) U.S. Cl. ..... 123/568.17

(58) Field of Classification Search ..... 123/568.11, 123/568.17, 568.18, 184.38, 184.53, 184.59
See application file for complete search history.

(56) References Cited

U.S. PATENT DOCUMENTS 4,693,226 A * 9/1987 Choma ..... 123/568.17
4,867,109 A * 9/1989 Tezuka et al. ..... 123/568.17
5,014,654 A * 5/1991 Ishibashi ..... 123/568.17
5,341,772 A * 8/1994 Dohring et al. ..... 123/568.17
6,895,948 B1 * 5/2005 Mori et al. ..... 123/568.17

FOREIGN PATENT DOCUMENTS

| | | |
|---|---|---|
| JP | 57-056655 | 4/1982 |
| JP | 10-122036 | 5/1998 |
| JP | 2000-008968 | 1/2000 |
| JP | 2002-339797 | 11/2002 |
| JP | 2002-339809 | 11/2002 |
| JP | 2003-074430 | 3/2003 |

* cited by examiner

*Primary Examiner*—Willis R. Wolfe, Jr.
(74) *Attorney, Agent, or Firm*—Donald R. Studebaker; Nixon Peabody, LLP

(57) ABSTRACT

An EGR plate member configured of an EGR plate inner and outer is interposed between a cylinder head and an intake manifold, including an exhaust gas recirculation passage formed therein. The EGR plate member has a lower protruding portion to protrude outward beyond respective connecting faces thereof with the cylinder head and the intake manifold. A common passage portion of the exhaust gas recirculation passage is substantially formed at the protruding portion. Part of the common passage portion has its laterally-long cross section which is offset toward the cylinder head. The offset portion of the EGR plate member has its greater thickness than other part thereof, extending below an intake port flange portion. Accordingly, the exhaust gas can be cooled by an outside air, thereby reducing an improper heat influence on the intake manifold.

10 Claims, 13 Drawing Sheets

EXHAUST GAS RECIRCULATION DEVICE OF ENGINE

BACKGROUND OF THE INVENTION

The present invention relates to an exhaust gas recirculation device of an engine, and more particularly to an exhaust gas recirculation device of en engine including inline-multi cylinders in which a recirculated exhaust gas is supplied to intake ports for engine cylinders.

In the exhaust gas recirculation device of an engine including inline-multi cylinders, an exhaust gas recirculation device which is , for example, a so-called "port EGR" is used for engines formotor vehicles or the like, in which the exhaust gas derived from an exhaust passage of the engine is supplied to intake ports of the engine via diverged exhaust gas recirculation passages so as to provide the exhaust gas into respective cylinders equally. As an exemplary of such "port EGR", the following device is known. Namely, in the exemplary device, there is provided a plate member for EGR (Exhaust Gas Recirculation) which is interposed between an intake port flange of a cylinder head and an intake manifold, and this plate member and the intake port flange portion jointly constitute a tournament-type of exhaust gas recirculation passage (EGR passage) for respective intake ports of plural engine cylinders which is comprised of a common passage portion, an upstream diverged passage portion and a downstream diverged passage portion. Further, an additional device which comprises cooling ribs which are provided at a periphery of such palate member is also known (see, for example, Japanese Patent Laid-Open Publication No. 2002-339809).

Meanwhile, for engines for motor vehicles or the like, an engine cylinder head made from aluminum is common, and an intake manifold made from resin is also common in order to further a weight reduction of the engine. Herein, in the event that such intake manifold made from resin is applied to the engine including inline-multi cylinders in which there is provided the above-described plate member interposed between the intake port flange of the cylinder head and the intake manifold to provide the port EGR, there exists the following problem. Namely, in general, the intake manifold made from resin has a heat resistance of approximately 120° C., but a gas temperature of the exhaust gas derived from the cylinder head to the plate member is approximately 150° C. Accordingly, the intake manifold made from resin may have a problem of its durability unless proper measures is taken because it receives an excessive-heat influence from the plate member.

Also, in the above-described device of the prior art, in which the upstream and downstream diverged passage portions are formed within the plate member and the common passage portion is formed at the intake port flange portion, the intake port flange portion needs to be relatively large in order to provide the common passage portion of thereat, resulting in a restriction in designing the cylinder head. Accordingly, it would prevent the engine from being compact. Further, constituting such exhaust gas recirculation passages over the plate member and the intake port flange portion would restrict proper designing of the exhaust gas passage.

SUMMARY OF THE INVENTION

The present invention has been devised in view of the above-described problems, and an object of the present invention is to provide an exhaust gas recirculation device of an engine including inline-multi cylinders comprising a plate member interposed between an intake port flange portion of a cylinder head and an intake manifold to supply an exhaust gas to the vicinity of respective intake ports of the engine cylinder, which can reduce any restrictions in designing the cylinder head and increase flexibility in designing the exhaust gas recirculation passage, along with preventing improper influence of the heat of the exhaust gas on the intake manifold.

According to the present invention, there is provided an exhaust gas recirculation device of an engine including inline-multi cylinders, comprising a cylinder head of the engine which includes an intake port flange portion thereof, an intake manifold for introducing an intake air into engine cylinders, which is made from resin, a plate member interposed between the intake port flange portion of the cylinder head and the intake manifold, the plate member including intake air openings which are formed so as to correspond to respective intake ports of the engine cylinders and an exhaust gas recirculation passage for a recirculated exhaust gas which is formed therein, wherein the exhaust gas recirculation passage formed in the plate member comprises an exhaust gas introducing portion, a common passage portion which connects with the exhaust gas introducing portion, and a diverged passage portion which diverges from the common passage portion and leads to respective intake ports of the engine cylinders, the plate member includes a protruding portion which is formed so as to protrude outward beyond respective connecting faces thereof with the cylinder head and the intake manifold, and most part of the common passage portion of the exhaust gas recirculation passage is substantially formed at the protruding portion of the plate member.

Accordingly, the exhaust gas recirculation passage comprising the common passage portion which connects with the exhaust gas introducing portion and the diverged passage portion which diverges from the common passage portion and leads to respective intake ports of the engine cylinders can be formed within the plate member interposed between the intake port flange portion of the cylinder head and the intake manifold. Thus, there is no need for any particular design of the port EGR at the cylinder head, thereby reducing any restrictions in designing the cylinder head. Further, the exhaust gas recirculation passage needs not to be formed over the plate member and the intake port flange portion, thereby increasing flexibility in designing the exhaust gas recirculation passage. Also, since most part of the common passage portion of the exhaust gas recirculation passage which is located near the exhaust gas introducing portion and thereby has a relatively high gas temperature is substantially formed at the protruding portion of the plate member, most part of the common passage portion can be located at outside beyond respective connecting faces of the palate member with said cylinder head and said intake manifold. Thus, the exhaust gas can be cooled at this portion by an outside air to properly reduce the temperature of the exhaust gas flowing in the exhaust gas recirculation passage within the plate member, thereby preventing improper influence of the heat of the exhaust gas on the intake manifold.

According to an preferred embodiment, the common passage portion of the exhaust gas recirculation passage is configured such that a passage sectional area thereof is greater than that of the diverged passage portion, and at least part of the common passage portion formed at the protruding portion has a passage center thereof which is offset from a passage center of the diverged passage portion toward the cylinder head of the engine.

Accordingly, since the common passage portion has its greater passage sectional area than the diverged passage portion, the flow speed of the exhaust gas at the common passage portion can be reduced. Also, since at least part of the common passage portion formed at the protruding portion has its passage center offset from the passage center of the diverged passage portion toward the cylinder head, the plate member can be disposed properly by utilizing a small space around the connecting portion between the cylinder head and the intake manifold.

According to another preferred embodiment, a portion of the plate member which corresponds to the part of the common passage portion having the offset passage center has a greater thickness than other part of the plate member.

Accordingly, a portion of the plate member which is disposed between the intake port flange portion and the intake manifold can be made thin, thereby further improving compactness of the engine.

Further, according to another preferred embodiment, the protruding portion of the plate member is located below the connecting face of the plate member with the cylinder head, and the portion of the plate member having the greater thickness protrudes toward a lower side of the intake port flange portion of the cylinder bead.

Accordingly, the plate member can be disposed properly by utilizing a small space around the connecting portion between the cylinder head and the intake manifold, and especially the space below the intake port flange portion can be utilized without any design changing of the cylinder head.

Further, according to another preferred embodiment, the plate member is configured of two split plates which are overlapped each other, and there are provided grooves which are formed at both overlapping faces of respective split plates so as to constitute jointly the exhaust gas recirculation passage.

Accordingly, the exhaust gas recirculation passage in the plate member can be formed easily and the designing flexibility of the passage can be increased.

Also, according to another preferred embodiment, the exhaust gas introducing portion is formed so as to open at a face of the plate member which constitutes the connecting face with the intake port flange portion of the cylinder head, and there is provided a recess for heat insulating between a specified portion of the plate member which corresponds to a location of the exhaust gas introducing portion and a portion of a flange portion of the intake manifold which faces to the specified portion of the plate member so as to insulate a heat transfer therebetween.

Accordingly, the heat transfer between the specified portion of the plate member which corresponds to the location of the exhaust gas introducing portion and the portion of the flange portion of the intake manifold which faces to the specified portion of the plate member can be insulated by the recess for heat insulating. As a result, the heat transfer from the plate member to the intake manifold can be suppressed, thereby reducing improper heat influence on the intake manifold made from resin.

Further, according to another preferred embodiment, the recess for heat insulating is formed by the portion of the flange portion of the intake manifold being retarded from the connecting face of the plate member with the intake manifold.

Accordingly, the recess for heat insulating can be formed in a resin molding of the intake manifold at the same time, thereby attaining a cost reduction.

Also, according to another preferred embodiment, an exhaust gas supplying portion to supply an exhaust gas to the exhaust gas introducing portion of the plate member is formed in the cylinder head so as to open at the intake port flange portion of the cylinder head.

Accordingly, the exhaust gas recirculation can be performed via the exhaust gas recirculation passage within the plate member, thereby providing a simple supplying system for the exhaust gas.

Further, according to another preferred embodiment, a seal ring is provided at a flange portion of the intake manifold, which is pressed to the plate member so as to encompass respective diverged passage openings of the intake manifold and the intake air openings of the plate member corresponding to the diverged passage openings, and a heat-insulating opening is formed at the plate member so as to penetrate the plate member which is positioned between the exhaust gas introducing portion or part of the common passage portion and at least one of the intake air openings which is located close thereto.

Accordingly, the seal ring can be insulated from the high-temperature portion of the plate member and thus heat transfer can be suppressed properly, thereby improving the durability of the seal ring.

DETAILED DESCRIPTION OF THE INVENTION

Figure 1:
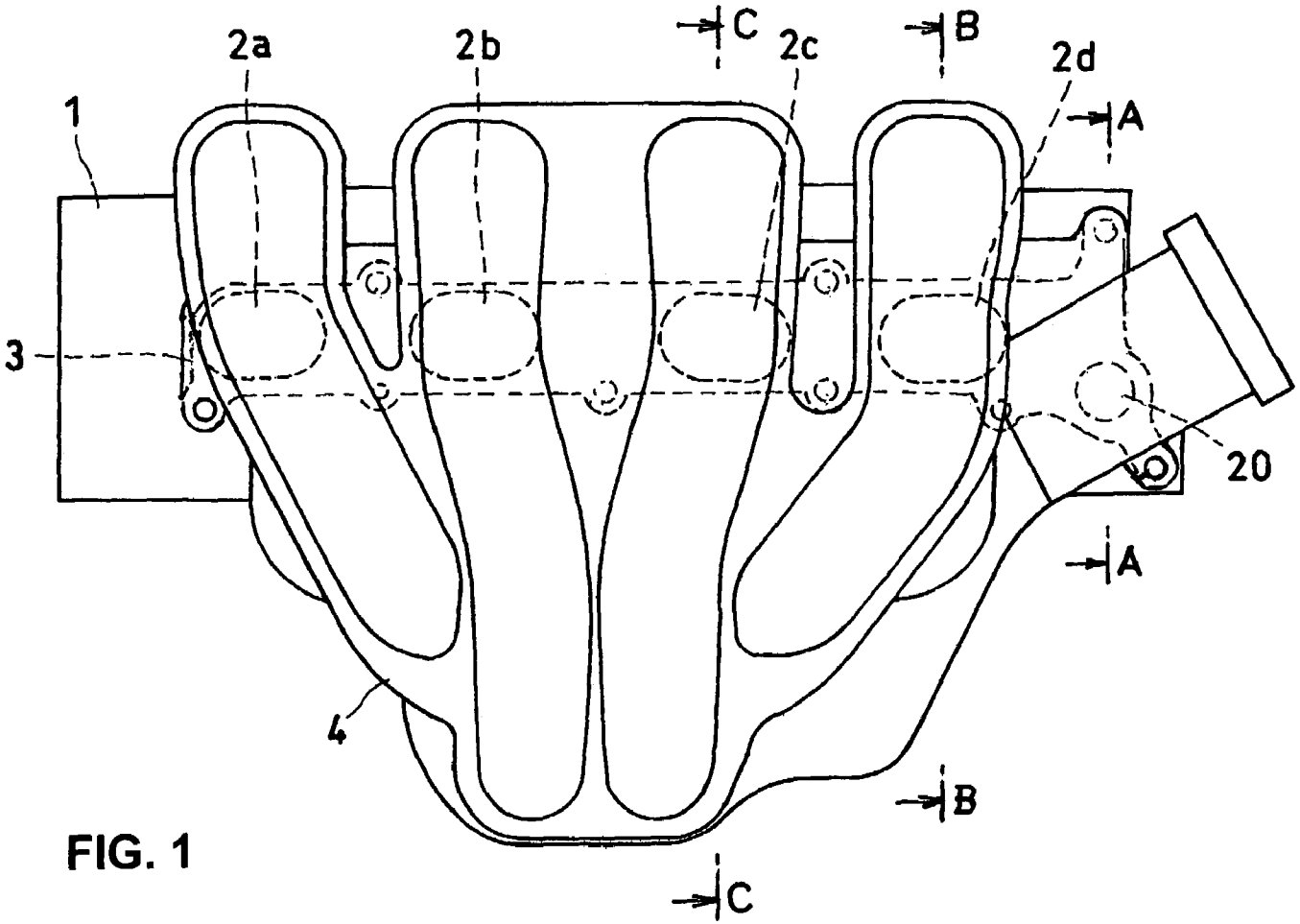
FIG. 1 is an elevation view of an upper portion of an engine according to a preferred embodiment of the present invention.
Figure 2:
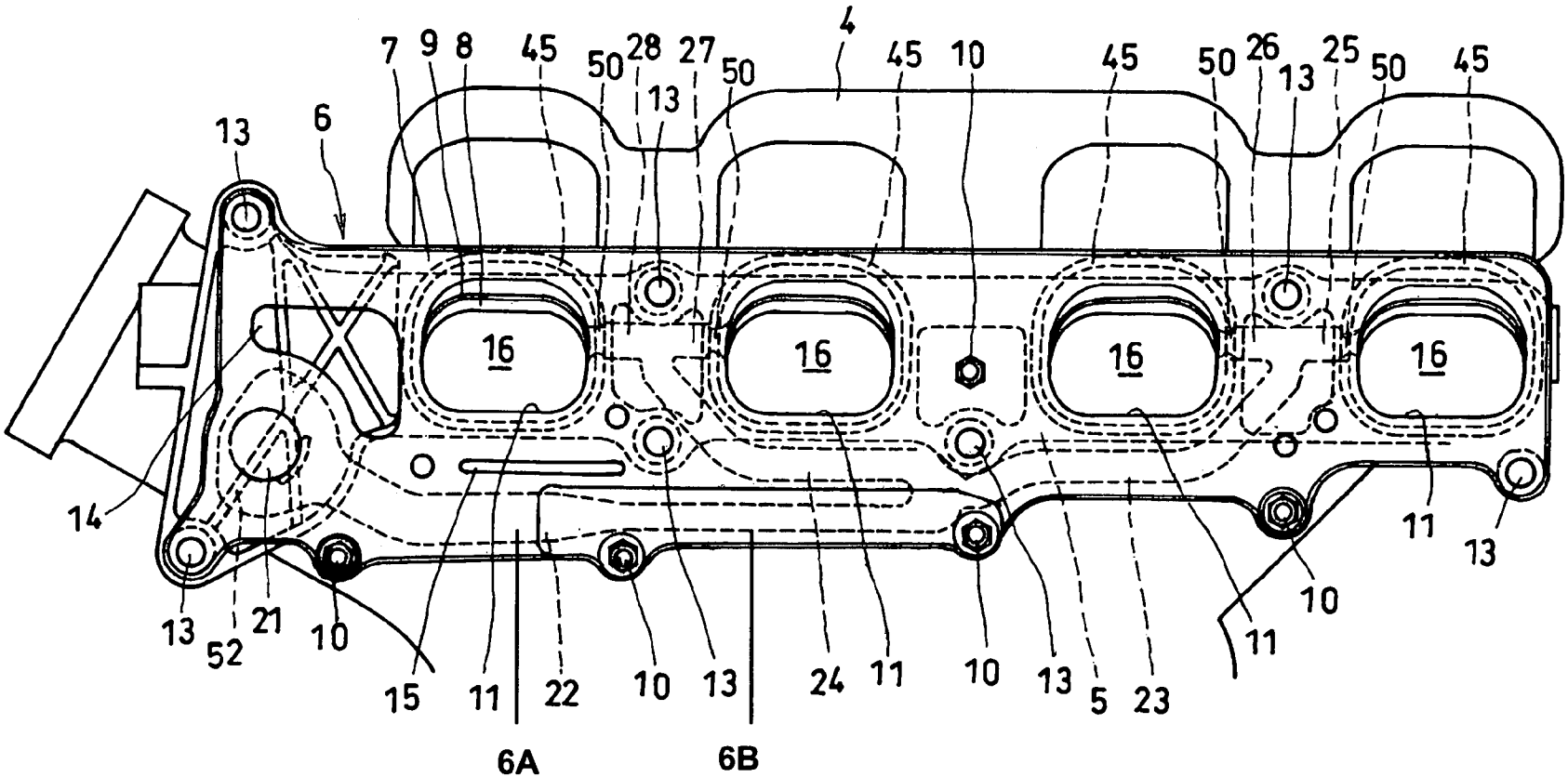
FIG. 2 is a view of an assembly of an intake manifold and an EGR plate member, when viewed from a side of a cylinder head which is located at the upper portion of the engine according to the preferred embodiment.
Figure 3:
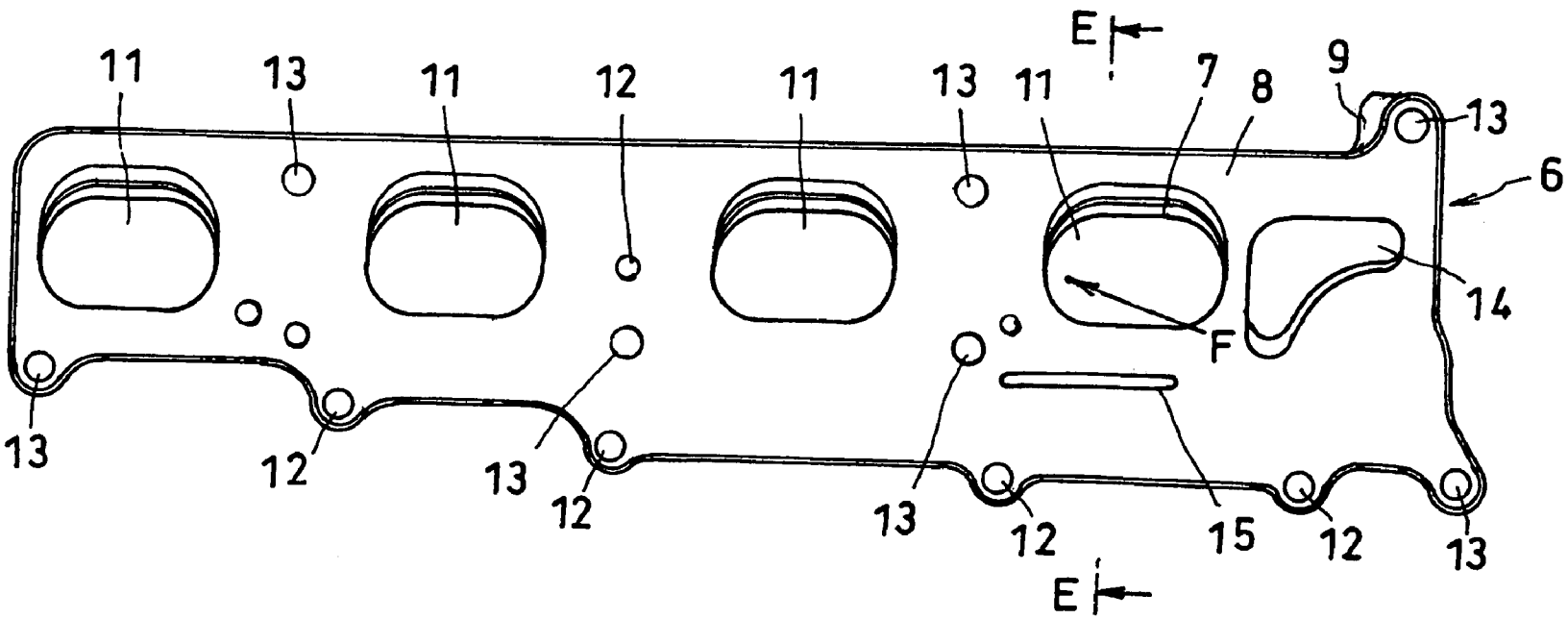
FIG. 3 is an elevation view of the EGR plate member according to the preferred embodiment.
Figure 4:
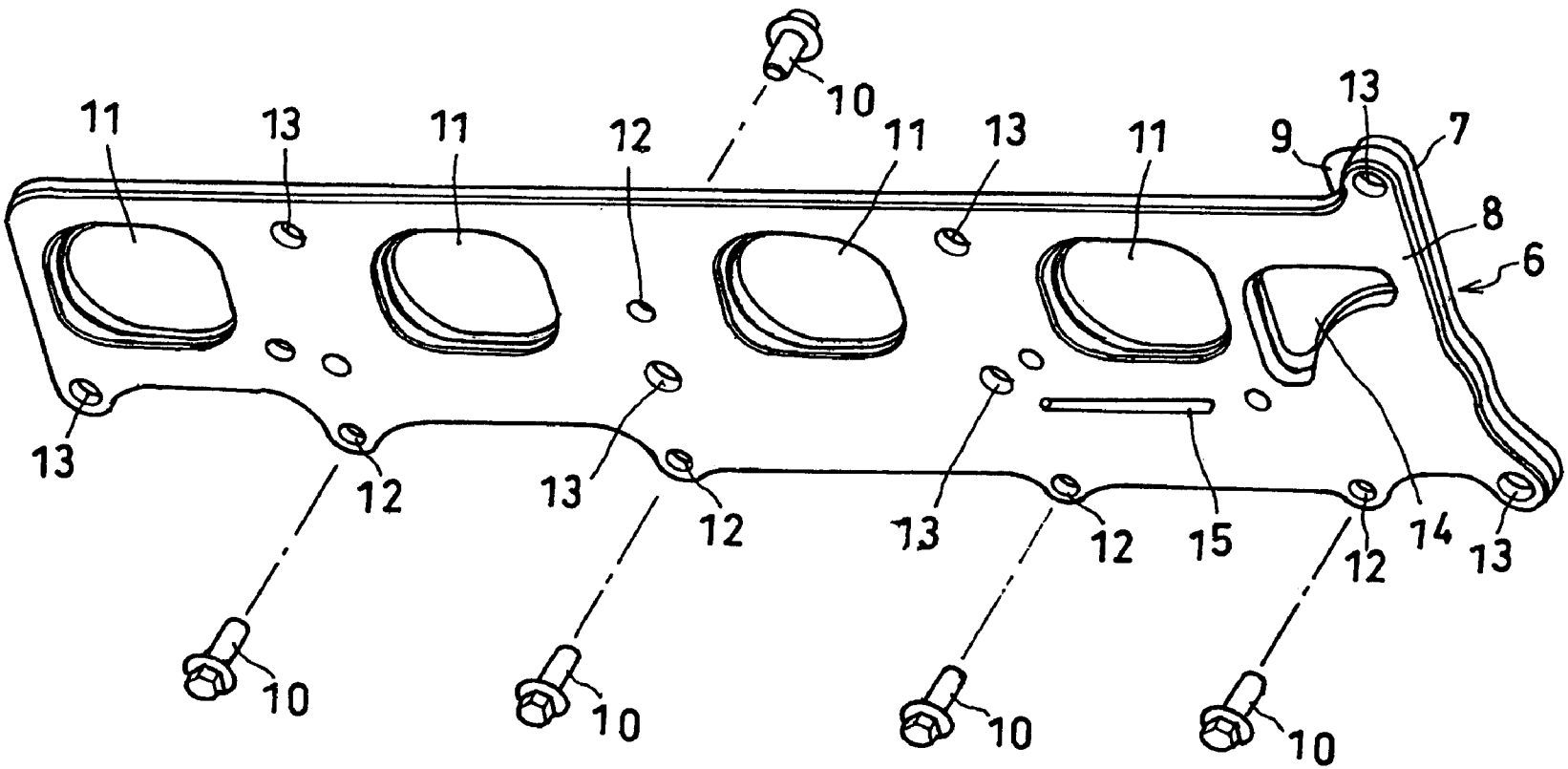
FIG. 4 is a perspective view of the EGR plate member of FIG. 3, when viewed from upper right.
Figure 5:
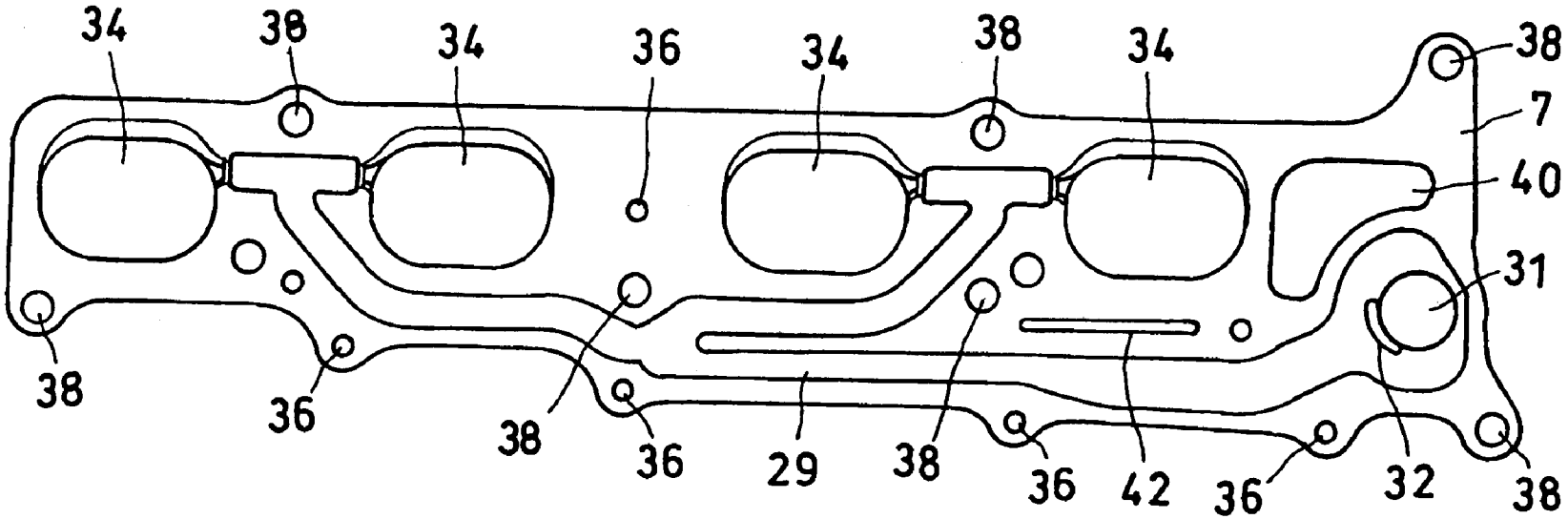
FIG. 5 is an elevation view of an EGR plate inner constituting the EGR plate member of FIG. 3.
Figure 6:
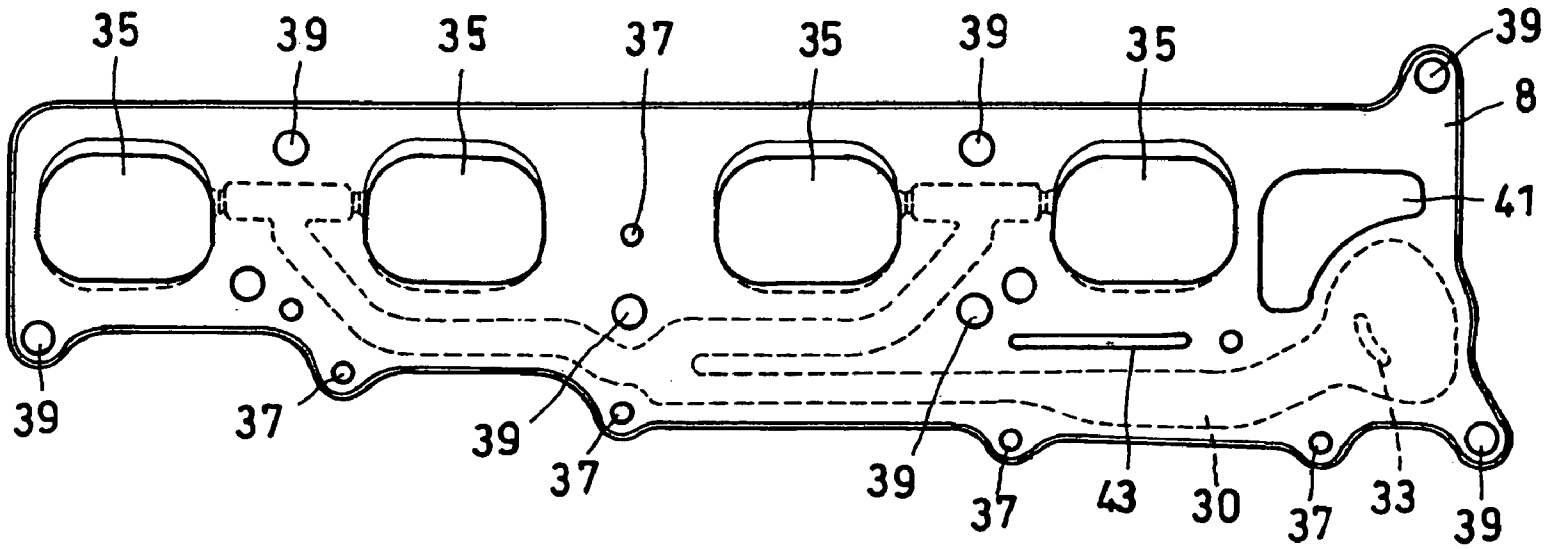
FIG. 6 is an elevation view of an EGR plate outer constituting the EGR plate member of FIG. 3.
Figure 7:
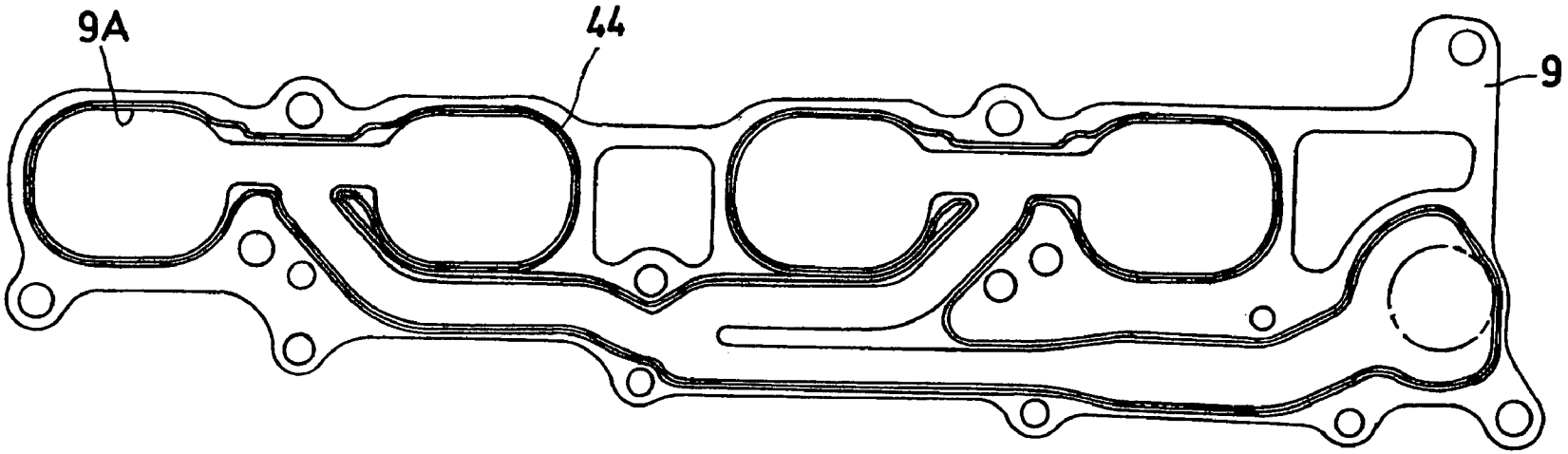
FIG. 7 is an elevation view of a gasket disposed between the plates of the EGR plate member of FIG. 3.
Figure 8:
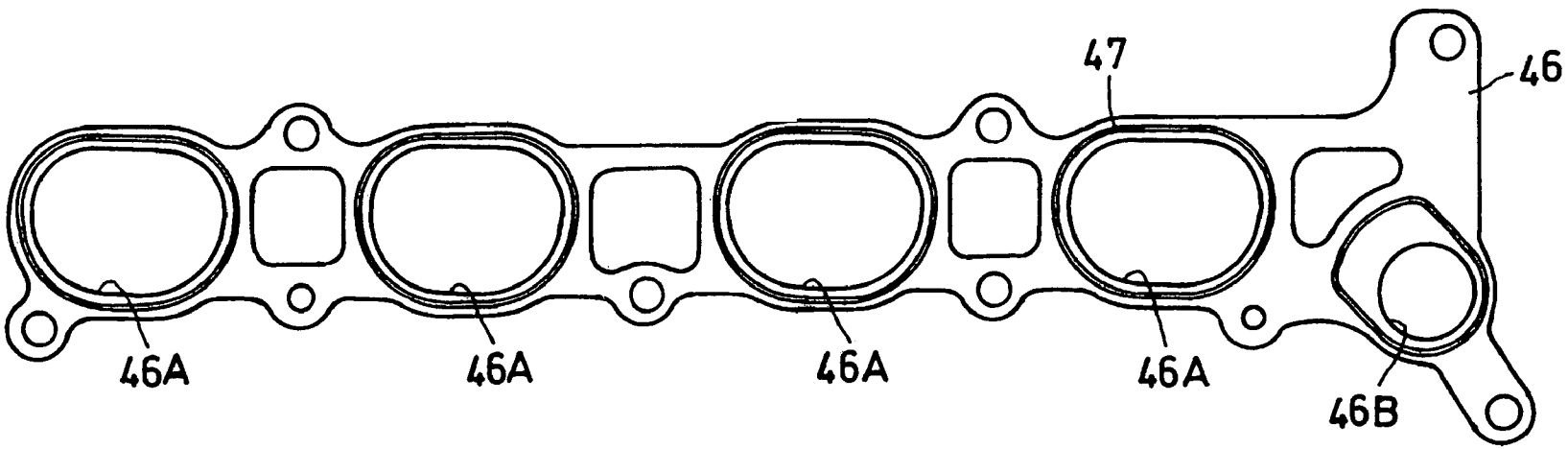
FIG. 8 is an elevation view of a gasket disposed between the EGR plate member and an intake port flange portion of the cylinder head according to the preferred embodiment.
Figure 9:
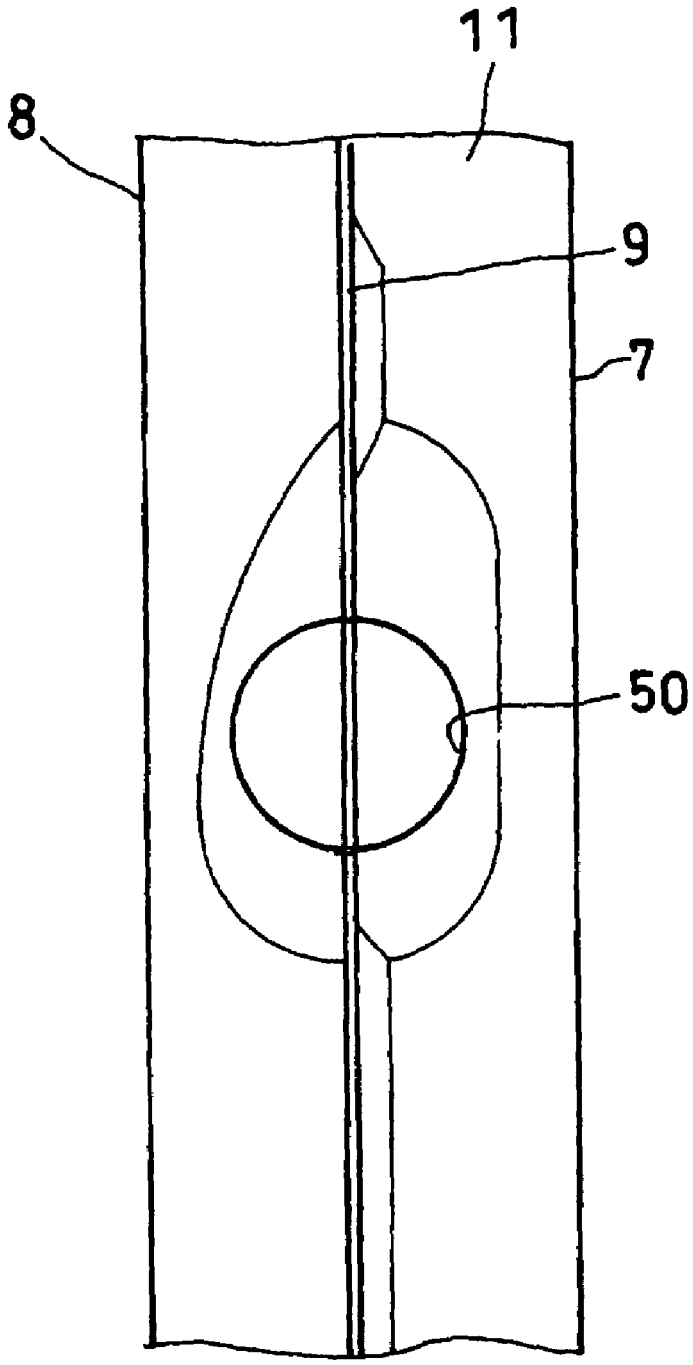
FIG. 9 is a sectional view taken on line E—E of FIG. 3.
Figure 10:
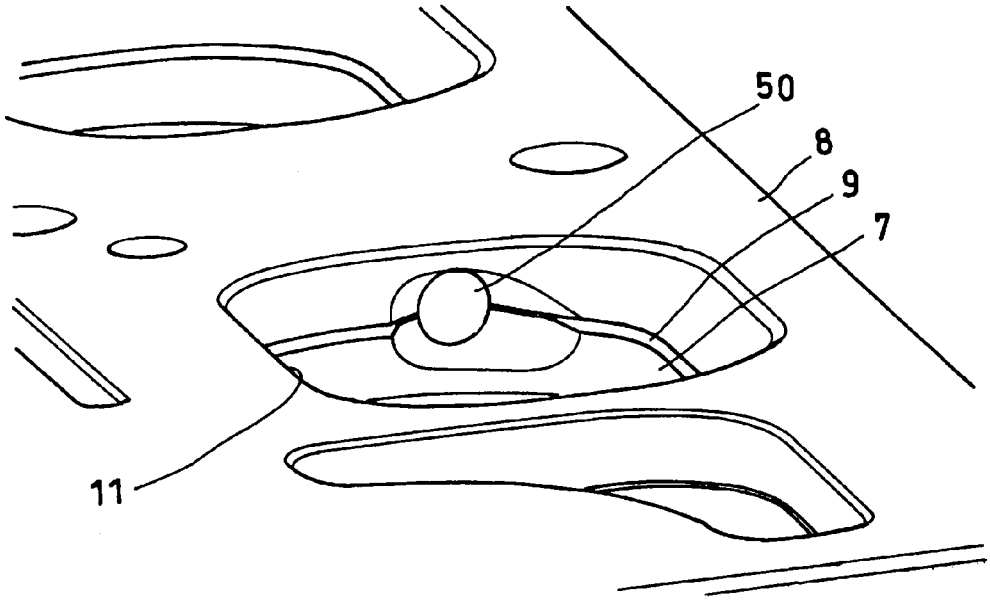
FIG. 10 is a perspective view of FIG. 3, when viewed in a direction denoted by an arrow F.
Figure 11:
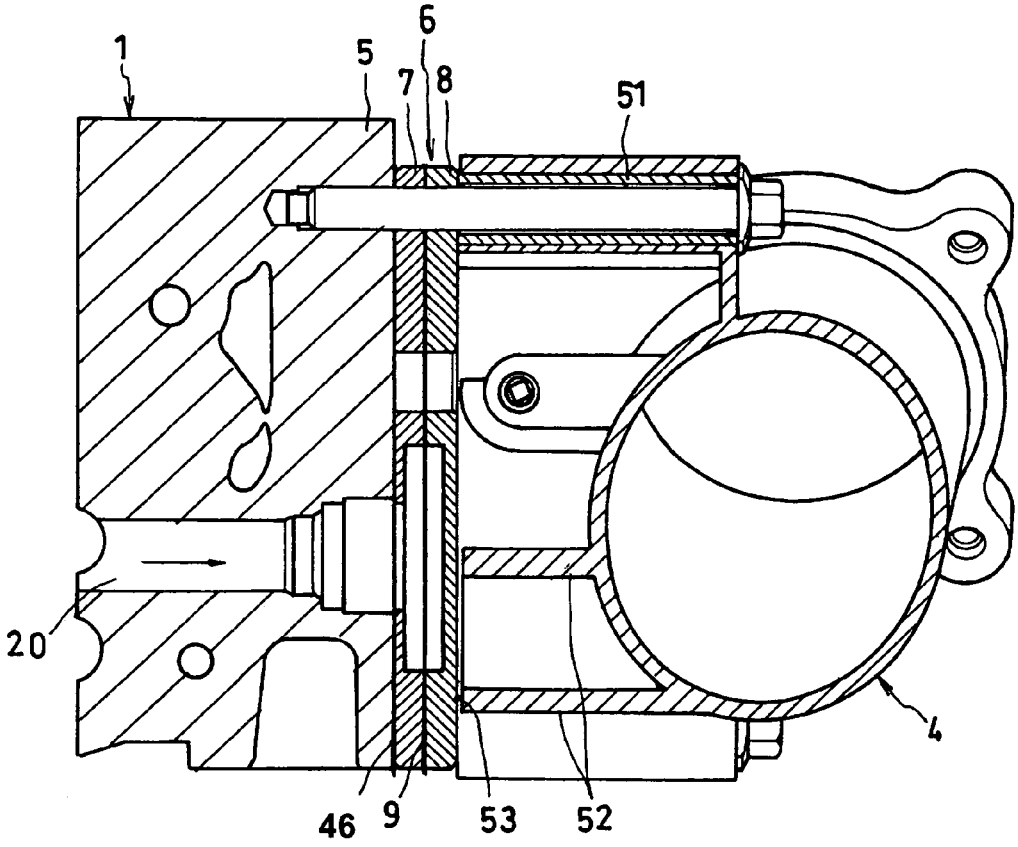
FIG. 11 is a sectional view taken on line A—A of FIG. 1.
Figure 12:
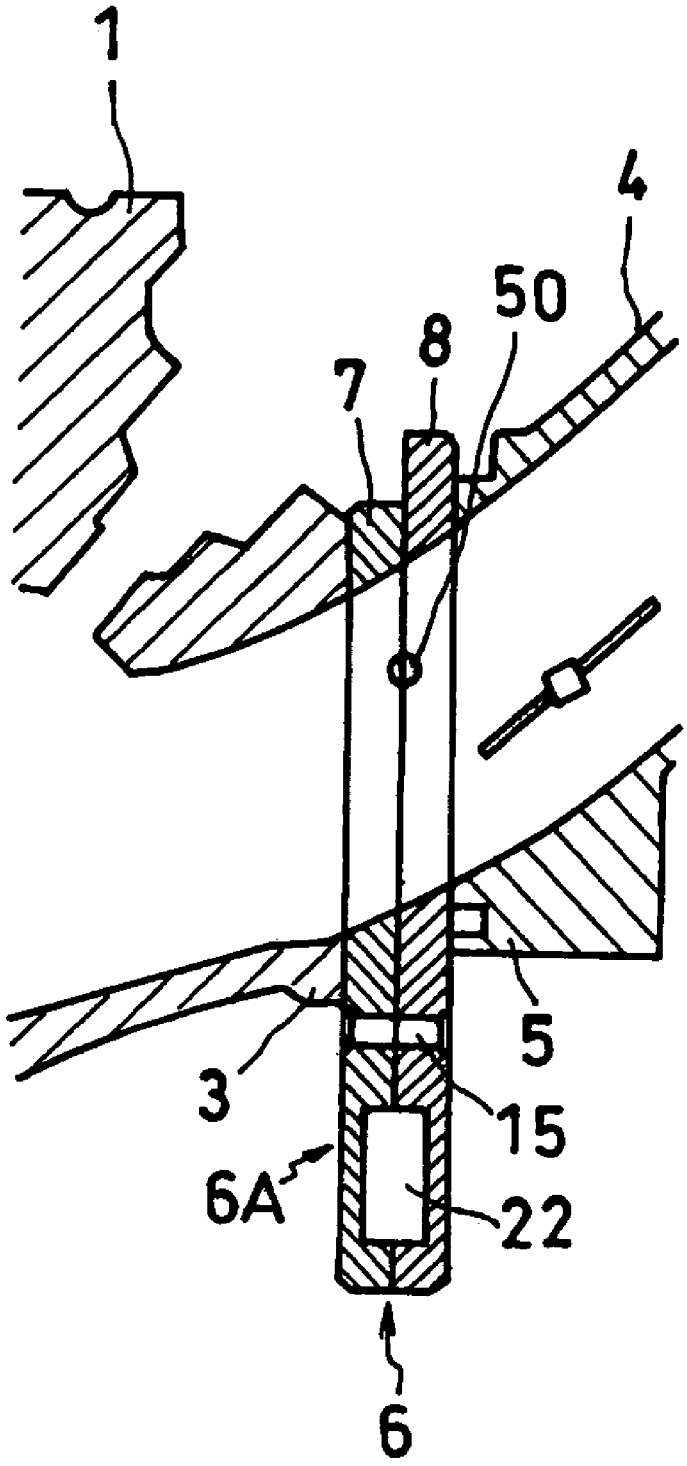
FIG. 12 is a sectional view taken on line B—B of FIG. 1.
Figure 13:
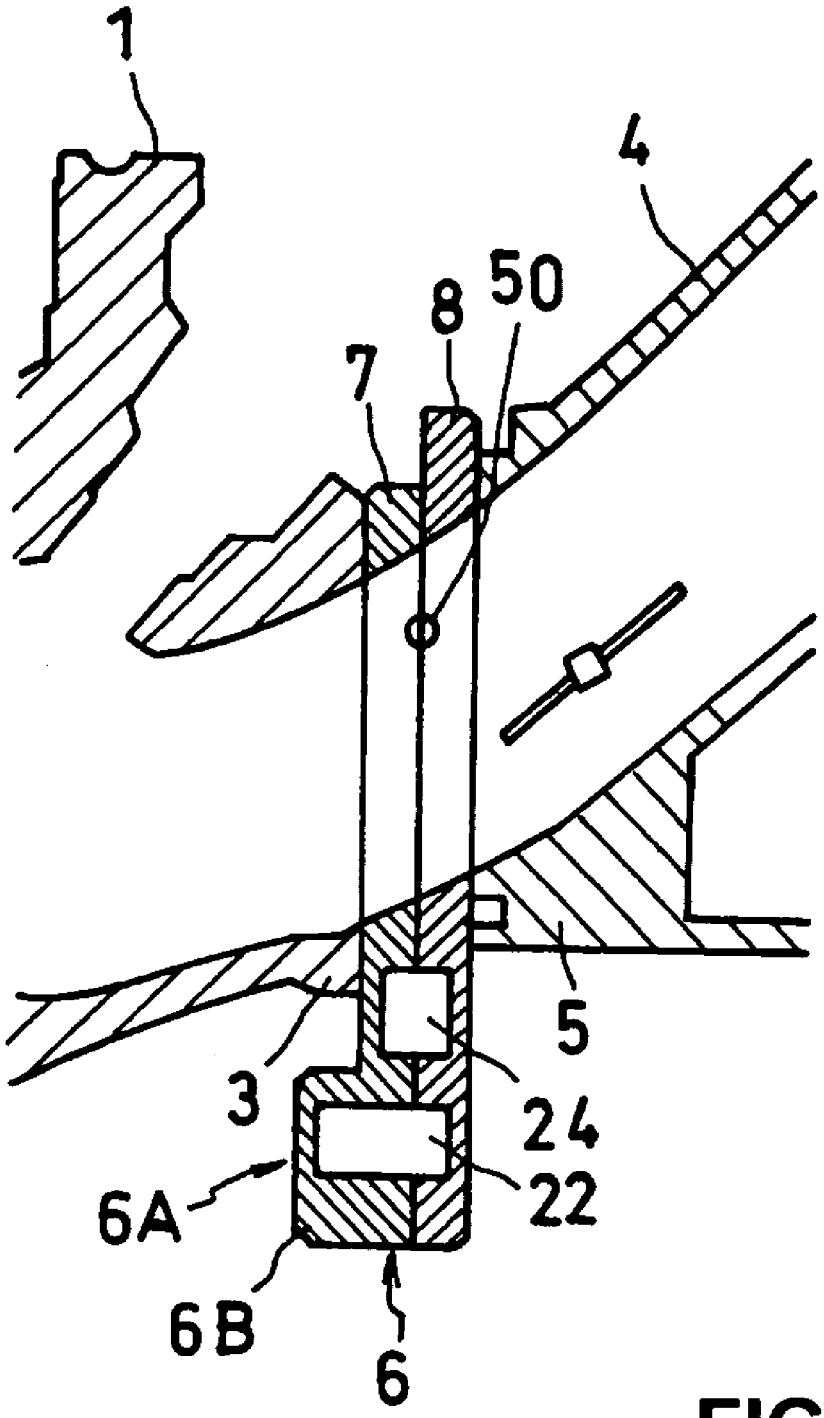
FIG. 13 is a sectional view taken on line C—C of FIG. 1.

Hereinafter, a preferred embodiment of the present invention will be described referring to FIGS. 1 through 13. FIG. 1 is an elevation view of an upper portion of an engine. FIG. 2 is a view of an assembly of an intake manifold and an EGR plate member, when viewed from a side of a cylinder head which is located at the upper portion of the engine. FIG. 3 is an elevation view of the EGR plate member. FIG. 4 is a perspective view of the EGR plate member of FIG. 3, when viewed from upper right. FIG. 5 is an elevation view of an EGR plate inner constituting the EGR plate member of FIG. 3. FIG. 6 is an elevation view of an EGR plate outer constituting the EGR plate member of FIG. 3. FIG. 7 is an elevation view of a gasket disposed between the plates of the EGR plate member of FIG. 3. FIG. 8 is an elevation view of a gasket disposed between the EGR plate member and an intake port flange portion of the cylinder head. FIG. 9 is a sectional view taken on line E—E of FIG. 3. FIG. 10 is a perspective view of FIG. 3, when viewed in a direction denoted by an arrow F. FIG. 11 is a sectional view taken on line A—A of FIG. 1. FIG. 12 is a sectional view taken on line B—B of FIG. 1. FIG. 13 is a sectional view taken on line C—C of FIG. 1.

An engine according to the present embodiment is a cross-flow type of inline-four-cylinder engine which is disposed in an engine room of a motor vehicle in a vehicle width direction. As shown in FIG. 1, a cylinder head 1 is provided with an intake port flange portion 3 having intake ports 2*a*, 2*b*, 2*c*, 2*d* for respective cylinders at its elevation. An intake manifold 4 is connected with the intake port flange portion 3. The cylinder head is made from aluminum, while the intake manifold 4 is made from resin.

The intake manifold 4 is, as shown in FIG. 2, overlapped with an EGR plate member 6 at its flange portion 5, which is fixed to the intake port flange portion 3 of the cylinder head 1 by bolts so as to put the EGR plate member 6 between them.

As shown in FIGS. 3 and 4, the EGR plate member 6 is configured in such a manner that two aluminum-cast split plates of an EGR plate inner 7 and an EGR plate outer 8 are overlapped putting the metal gasket 9 between them and fastened integrally by screws 10 (plate fastening screws). It has a rectangular shape when viewed from its elevation, and its width in a height direction expands downwardly, from left to right, in three steps. The EGR plate inner 7 is located at a side of the cylinder head 1, while the EGR plate outer 8 is located at a side of the intake manifold 4.

The EGR plate member 6 includes intake air openings 11 . . . 11 which are formed so as to correspond to intake ports 2*a*, 2*b*, 2*c*, 2*d* opened at the intake port flange portion 3 of the cylinder head 1, screw holes 12 . . . 12 for plate fastening, bolt holes 13 . . . 13 for intake manifold fastening to the cylinder head 1 along with the intake manifold 4. Further, heat-insulating openings 14, 15 are formed respectively at right of and below the rightmost intake air opening 11 of the EGR plate member 6 so as to penetrate the plate member 6. Herein, the right-side heat-insulating opening 14 is a penetrating hole with a substantially triangle section encompassing a right-end and lower portion of the EGR plate member 6, while the lower-side heat-insulating opening 15 is a slit-shaped penetrating hole which extends horizontally so as to separate the rightmost intake air opening 11 from a lower extending portion constituting part of the plate member 6 with its maximum width in the height direction.

In the EGR plate member 6, as shown in FIG. 2, there is provided a so-called tournament-type of exhaust gas recirculation passage to distribute an exhaust gas to respective intake ports 2*a*, 2*b*, 2*c*, 2*d* of the four engine cylinders, which comprises an exhaust gas introducing portion 21, a common passage portion 22 which connects with the exhaust gas introducing portion 2.1, a pair of upstream diverged passages 23, 24 which diverge from the common passage portion 22 and extend to the right and left, and two pair of downstream diverged passages 25, 26 and 27, 28 which diverge from respective ends of the upstream diverged passages 23, 24 and extend to the right and to the left.

The exhaust gas introducing portion 21 connects with an exhaust gas supplying portion 21 (see FIG. 1) for EGR (Exhaust Gas Recirculation) which is formed at the intake port flange portion 3 of the cylinder head 1 so as to introduce the EGR gas (gas for Exhaust Gas Recirculation) within the EGR plate member 6, which is located at its left-end lower portion when viewed from a side of the cylinder head 1 (at its right-end lower portion when viewed from the elevation), as shown in FIG. 2. Further, as shown in FIG. 2, the common passage portion 22 extends from the exhaust gas introducing portion 21 along a lower edge of the lower extending portion of the EGR plate member 6 to a portion between two central-positioned intake air openings 11, 11. Then, the pair of upstream diverged passages 23, 24 diverge from the common passage portion 22 at this portion and extend respectively to portions between two left-positioned intake air openings 11, 11 and two right-positioned intake air openings 11, 11. Then, two pair of downstream diverged passages 25, 26 and 27, 28 diverge from respective ends of the upstream diverged passages 23, 24 at these portions and extend to the right and to the left so as to reach the respective intake air openings 11 . . . 11.

As shown in FIGS. 5 and 6, there are provided grooves 29, 30 with a half-split shape which are formed respectively at overlapping faces of EGR plate inner 7 and EGR plate outer 8 for the above-described exhaust gas introducing portion 21, the common passage portion 22, the upstream diverged passages 23, 24 and the downstream diverged passages 25, 26 and 27, 28. When the EGR plate inner 7 and EGR plate outer 8 are overlapped, these grooves 29 and 30 constitute jointly the exhaust gas recirculation passage which is comprised of the exhaust gas introducing portion 21, the common passage portion 22, the upstream diverged passages 23, 24 and the downstream diverged passages 25, 26 and 27, 28.

Also, there is provided an opening 31 at the center of an enlarged portion constituting the exhaust gas introducing portion 21 in the groove 29 of the EGR plate inner 7, which connects with he above-described exhaust gas supplying portion 20 at the side of the cylinder head 1. There are also provided baffle projections 32, 33 at the EGR plate inner 7 and EGR plate outer 8 so as to provide a flow resistance to the exhaust gas which has been introduced via the opening from the exhaust gas supplying portion 20 at the side of cylinder head 1 and flows into the common passage portion 22. Namely, when the EGR plate inner 7 and the EGR plate outer 8 are overlapped, these baffle projections 32, 33 constitute jointly a baffle to wall up part of peripheral portion of the opening 31. The exhaust gas supplied from the exhaust gas supplying portion 20 of the cylinder head 1 expands rapidly when entering into the exhaust gas introducing portion 21 with a flat and enlarged sectional space. Further, the exhaust gas radiates heat due to its pressure loss at the baffle projections 32, 33. Accordingly, the temperature of the exhaust gas decreases more properly.

As shown in FIGS. 5 and 6, at the EGR plate inner 7 and the EGR plate outer 8, there are provided openings 34 . . . 34, 35 . . . 35 forming the intake air openings 11 . . . 11, holes 36 . . . 36, 37 . . . 37 forming the screw holes for plate fastening 12 . . . 12, holes 38 . . . 38, 39 . . . 39 forming the bolt holes for intake manifold fastening 13 . . . 13, holes 40, 41 and 42, 43 for the heat-insulating openings 14, 15.

The meal gasket 9 interposed between the EGR plate inner 7 and the EGR plate outer 8, as shown in FIG. 7, has an opening 9A which is so formed as to encompass the openings 34 . . . 34, 35 . . . 35 forming the intake air openings 11 . . . 11 and the grooves 29, 30 which constitute the exhaust gas introducing portion 21, the common passage portion 22, the upstream diverged passages 23, 24 and the downstream diverged passages 25, 26 and 27, 28. Further, there is provided a bead 44 for sealing at along an internal edge of the opening 9A.

The EGR palate member 6 is fastened to the cylinder head 1 along with the intake manifold 4 by bolts in such a manner that it is attached to the flange portion 5 of the intake manifold 4 via rubber seal rings 45 . . . 45 (O rings) encompassing the intake air openings 11 . . . 11, as shown in FIG. 2, which is interposed therebetween, while it is attached to the intake port flange portion 3 of the cylinder head 1 via a metal gasket 46, as shown in FIG. 8, which is interposed therebetween. At the metal gasket 46 located at the side of the cylinder head 1, openings 46A . . . 46A, 46B are formed so as to encompass respectively the intake air openings 11 . . . 11 and the exhaust gas introducing portion 21 as shown in FIG. 8, and there are provided beads 47 . . . 47 for sealing at along internal edges of the opening 46A . . . 46A, 46B.

The seal rings 45 . . . 45 are pressed to the flange portion 5 of the intake manifold 4 so as to encompass the openings 16 . . . 16, and they are also pressed to the EGR plate member 6 so as to encompass the intake air openings 11 . . . 11 of the EGR plate member 6 corresponding to the openings 16 . . . 16.

The exhaust gas recirculation passage is disposed in the EGR plate member 6 in such a manner that ends of the downstream diverged passages 25, 26 and 27, 28 are open to the respective intake air openings 11 . . . 11 and there are orifices 50 . . . 50 at the end opening portions as shown in FIG. 2. The end opening portions of respective downstream diverged passages 25, 26 and 27, 28 are formed in a taper shape so as to expand gradually downstream, as shown in FIG. 2 and enlarged FIGS. 9 and 10.

The recirculated exhaust gas distributed into each cylinder through the exhaust gas recirculation passage in the EGR plate member 6 is adjusted uniformly by the above-described orifices 50 . . . 50 at the ends of the downstream diverged passages 25, 26 and 27, 28. Further, the orifices 50 . . . 50 with the taper shape make flows of the recirculated gas smooth, so that any accumulation of oil mists or carbon can be suppressed properly.

The intake manifold 4 is, as shown in FIGS. 2 and 11, fastened to the cylinder head 1 by bolts via collars 51 . . . 51, which are made from metal, putting the EGR plate member 6 therebetween. Also, there is provided rigidity ribs 52 . . . 52 at the intake manifold 4, which is positioned so as to face to the exhaust gas introducing portion 21 and part of the common passage portion 22 near the exhaust gas introducing portion 21 of the EGR plate member 6. The rigidity ribs 52 . . . 52 are also formed so as to be retarded from its vicinity portions. Accordingly, there is provided a recess for heat insulating 53 between the above-described portion (a specified portion) of the EGR plate member and the above-described portion (a specified portion) of the flange portion 5 of the intake manifold 4 so as to insulate a heat transfer therebetween.

Further, the exhaust gas recirculation passage in the EGR plate member 6 is configured such that a passage sectional area of the upstream diverged passages 23, 24 is greater than that of the downstream diverged passages 25, 26 and 27, 28, and a passage sectional area of the common passage portion 22 is greater than that of the upstream diverged passages 23, 24.

The above-described lower extending portion of the EGR plate member 6 with its three-step expansion form constitutes a protruding portion 6A which protrudes outward beyond connecting faces thereof with the cylinder head 1 and the intake manifold 4 when the EGR plate member 6 is fastened by bolts to be interposed between the cylinder head 1 and the intake manifold 4. Then, most part of the common passage portion 22 is substantially formed at the above-described protruding portion 6A and some upstream portions of the upstream diverged passages 23, 24 are also formed at the protruding portion 6A.

The common passage portion 22 is formed such that its cross section of its upstream portion near the exhaust gas introducing portion 21 is of vertically-long shape so as to provide its larger sectional area, as shown in FIG. 12. On the other hand, its cross section of its downstream portion disposed in parallel to the upstream diverged passage portion 24 is of laterally-long shape so as to provide its larger sectional area with avoiding any interference with the upstream diverged passage portion 24, as shown in FIG. 13.

Also, as shown in FIG. 13, the portion having its laterally-long cross section of the common passage portion 22 has a passage center thereof in a thickness direction of the EGR plate member 6 which is offset from a passage center of part of the diverged passage portion 24 which is positioned at the joining face of the EGR plate inner and outer 7, 8 toward the cylinder head 1. The EGR plate member 6 is configured such that its part corresponding to the portion of the common passage portion 22 having the offset passage center has a greater thickness than other part of the EGR plate member 6, and the portion 6B having the greater thickness protrudes toward a lower side of the intake port flange portion 3 of the cylinder head 1 so as to utilized a space below the intake port flange portion 3 effectively.

According to the present embodiment, as described above, there is provided the exhaust recirculation passage which comprises the exhaust gas introducing portion 21, the common passage portion 22 connecting with the exhaust gas introducing portion 21, the upstream diverged passages 23, 24 derived from the common passage portion 22, and the downstream diverged passages 25, 26 and 27, 28 derived further from the upstream diverged passages 23, 24, in the EGR plate member 6 interposed between the intake port flange portion 3 of the cylinder head 1 and the intake manifold 4. Thus, the exhaust gas introduced into the exhaust gas introducing portion 21 from the exhaust gas introducing port at the cylinder head 1 is distributed to the respective intake ports 2*a*, 2*b*, 2*c*, 2*d* for cylinders via the common passage portion 22, the upstream diverged passages 23, 24, and the downstream diverged passages 25, 26 and 27, 28. Accordingly, there is hardly restrictions in designing the cylinder head 1 which has only the exhaust gas introducing port to communicate with the exhaust gas introducing portion 21, and also the flexibility in designing the exhaust gas recirculation passage can be increased.

Further, most part of the common passage portion 22, which is positioned close to the exhaust gas introducing portion 21 in the EGR plate member 6 and thereby has a relatively high gas temperature, and the upstream portion of the upstream diverged passages 23, 24 are formed at the protruding portion 6A (lower extending portion) of the EGR plate member 6 which protrudes beyond the connecting face with the cylinder head 1 and the contour of the intake manifold. Also, the common passage potion 22 has a relatively large surface area thereof with its cross sections of the vertically-long shape and the laterally-long shape. Accordingly, since its cooling effect by an outside air is superior, the exhaust gas flowing in the exhaust gas recirculation passage of the EGR plate member 6 can be decreased, thereby reducing an improper heat influence on the resin intake manifold 4.

Also, the heat transfer from the high-temperature portion of the EGR plate member 6 to the intake manifold 4 is suppressed properly by the recess for heat insulating 53. As a result, improper heat influence on the resin intake manifold 6 can be avoided. The recess for heat insulating 53 may be formed in a resin molding of the intake manifold 4 at the same time.

Further, since the heat-insulating openings 14, 15 are formed at the EGR plate member 6 of the present embodiment, the seal rings 45 . . . 45 which are disposed between the flange portion 5 of the intake manifold 4 and the EGR plate member 6 encompassing the respective intake air openings 11 . . . 11 can be insulated from the high-temperature portion of the EGR plate member 6 and thus the heat transfer can be suppressed properly, thereby preventing deterioration of the durability of the seal rings 45 . . . 45.

The above-described embodiment shows one of exemplified preferred embodiments. The present invention should not be limited to the above embodiment, and any modifications may be adopted within the scope of the claimed invention. For example, although the above-described EGR plate member 6 is formed of split members of the inner and outer members 7, 8, it may be formed of a single member. Herein, the exhaust recirculation passage may be formed by the use of a core in casting.

What is claimed is:

1. An exhaust gas recirculation device of an engine including inline-multi cylinders, comprising:

a cylinder head of the engine which includes an intake port flange portion thereof;

an intake manifold for introducing an intake air into engine cylinders, which is made from resin;

a plate member interposed between said intake port flange portion of the cylinder head and said intake manifold, the plate member including intake air openings which are formed so as to correspond to respective intake ports of the engine cylinders and an exhaust gas recirculation passage for a recirculated exhaust gas which is formed therein, wherein said exhaust gas recirculation passage formed in the plate member comprises an exhaust gas introducing portion, a common passage portion which connects with the exhaust gas introducing portion, and a diverged passage portion which diverges from the common passage portion and leads to respective intake ports of the engine cylinders, said plate member includes a protruding portion which is formed so as to protrude outward beyond respective connecting faces thereof with said cylinder head and said intake manifold, said common passage portion of the exhaust gas recirculation passage is substantially formed at said protruding portion of the plate member, and said plate member is configured of two split plates which are overlapped each other and there are provided grooves which are formed at both overlapping faces of respective split plates so as to constitute jointly said exhaust gas recirculation passage.

2. An exhaust gas recirculation device of an engine including inline-multi cylinders, comprising:

a cylinder head of the engine which includes an intake port flange portion thereof;

an intake manifold for introducing an intake air into engine cylinders, which is made from resin;

a plate member interposed between said intake port flange portion of the cylinder head and said intake manifold, the plate member including intake air openings which are formed so as to correspond to respective intake ports of the engine cylinders and an exhaust gas recirculation passage for a recirculated exhaust gas which is formed therein, wherein said exhaust gas recirculation passage formed in the plate member comprises an exhaust gas introducing portion, a common passage portion which connects with the exhaust gas introducing portion, and a diverged passage portion which diverges from the common passage portion and leads to respective intake ports of the engine cylinders, said plate member includes a protruding portion which is formed so as to protrude outward beyond respective connecting faces thereof with said cylinder head and said intake manifold, said common passage portion of the exhaust gas recirculation passage is substantially formed at said protruding portion of the plate member, said plate member is configured of two split plates which are overlapped each other and there are provided grooves which are formed at both overlapping faces of respective split plates so as to constitute jointly said exhaust gas recirculation passage, and said exhaust gas introducing portion is formed so as to open at a face of said plate member which constitutes said connecting face with said intake port flange portion of the cylinder head, and there is provided a recess for heat insulating between a specified portion of said plate member which corresponds to a location of said exhaust gas introducing portion and a portion of a flange portion of said intake manifold which faces to said specified portion of the plate member so as to insulate a heat transfer therebetween.

3. An exhaust gas recirculation device of an engine including inline-multi cylinders, comprising:

a cylinder head of the engine which includes an intake port flange portion thereof;

an intake manifold for introducing an intake air into engine cylinders, which is made from resin;

a plate member interposed between said intake port flange portion of the cylinder head and said intake manifold, the plate member including intake air openings which are formed so as to correspond to respective intake ports of the engine cylinders and an exhaust gas recirculation passage for a recirculated exhaust gas which is formed therein, wherein said exhaust gas recirculation passage formed in the plate member comprises an exhaust gas introducing portion, a common passage portion which connects with the exhaust gas introducing portion, and a diverged passage portion which diverges from the common passage portion and leads to respective intake ports of the engine cylinders, said plate member includes a protruding portion which is formed so as to protrude outward beyond respective connecting faces thereof with said cylinder head and said intake manifold, said common passage portion of the exhaust gas recirculation passage is substantially formed at said protruding portion of the plate member, said plate member is configured of two split plates which are overlapped each other and there are provided grooves which are formed at both overlapping faces of respective split plates so as to constitute jointly said exhaust gas recirculation passage, a seal ring is provided at a flange portion of said intake manifold, which is pressed to said plate member so as to encompass respective diverged passage openings of said intake manifold and said intake air openings of the plate member corresponding to the diverged passage openings, and a heat-insulating opening is formed at said plate member so as to penetrate the plate member which is positioned between said exhaust gas introducing portion or part of said common passage portion and at least one of said intake air openings which is located close thereto.

4. An exhaust gas recirculation device of an engine including inline-multi cylinders, comprising:

a cylinder head of the engine which includes an intake port flange portion thereof;

an intake manifold for introducing an intake air into engine cylinders, which is made from resin;

a plate member interposed between said intake port flange portion of the cylinder head and said intake manifold, the plate member including intake air openings which are formed so as to correspond to respective intake ports of the engine cylinders and an exhaust gas recirculation passage for a recirculated exhaust gas which is formed therein, wherein said exhaust gas recirculation passage formed in the plate member comprises an exhaust gas introducing portion, a common passage portion which connects with the exhaust gas introducing portion, and a diverged passage portion which diverges from the common passage portion and leads to respective intake ports of the engine cylinders, said plate member includes a protruding portion which is formed so as to protrude outward beyond respective connecting faces thereof with said cylinder head and said intake manifold, and most part of said common passage portion of the exhaust gas recirculation passage is substantially formed at said protruding portion of the plate member, wherein said common passage portion of the exhaust gas recirculation passage is configured such that a passage sectional area thereof is greater than that of said diverged passage portion, and at least part of said common passage portion formed at said protruding portion has a passage center thereof which is offset from a passage center of said diverged passage portion toward said cylinder head of the engine, and wherein a portion of the said plate member which corresponds to said part of the common passage portion having the offset passage center has a greater thickness than other part of the plate member.

5. The exhaust gas recirculation device of an engine of claim 4 wherein said protruding portion of the plate member is located below the connecting face of the plate member with said cylinder head, and said portion of the plate member having the greater thickness protrudes toward a lower side of said intake port flange portion of the cylinder head.

6. The exhaust gas recirculation device of an engine of claim 4, wherein said plate member is configured of two split plates which are overlapped each other, and there are provided grooves which are formed at both overlapping faces of respective split plates so as to constitute jointly said exhaust gas recirculation passage.

7. The exhaust gas recirculation device of an engine of claim 4 wherein a seal ring is provided at a flange portion of said intake manifold, which is pressed to said plate member so as to encompass respective diverged passage openings of said intake manifold and said intake air openings of the plate member corresponding to the diverged passage openings, and a heat-insulating opening is formed at said plate member so as to penetrate the plate member which is positioned between said exhaust gas introducing portion or part of said common passage portion and at least one of said intake air openings which is located close thereto.

8. The exhaust gas recirculation device of an engine of claim 4, wherein said exhaust gas introducing portion is formed so as to open at a face of said plate member which constitutes said connecting face with said intake port flange portion of the cylinder head, and there is provided a recess for heat insulating between a specified portion of said plate member which corresponds to a location of said exhaust gas introducing portion and a portion of a flange portion of said intake manifold which faces to said specified portion of the plate member so as to insulate a heat transfer therebetween.

9. The exhaust gas recirculation device of an engine of claim 8, wherein said recess for heat insulating is formed by said portion of the flange portion of the intake manifold being retarded from said connecting face of the plate member with said intake manifold.

10. The exhaust gas recirculation device of an engine of claim 8, wherein an exhaust gas supplying portion to supply an exhaust gas to said exhaust gas introducing portion of the plate member is formed in said cylinder head so as to open at said intake port flange portion of the cylinder head.

* * * * *